United States Patent [19]

Overfield

[11] 4,336,781

[45] Jun. 29, 1982

[54] FUEL INJECTION PUMP SNUBBER

[75] Inventor: Norbert W. Overfield, Bloomfield, Conn.

[73] Assignee: Stanadyne, Inc., Windsor, Conn.

[21] Appl. No.: 144,328

[22] Filed: Apr. 28, 1980

[51] Int. Cl.[3] ..... F02M 41/12

[52] U.S. Cl. ..... 123/467; 123/450; 417/307

[58] Field of Search ..... 123/450, 467, 506; 417/462, 307

[56] References Cited

U.S. PATENT DOCUMENTS 2,052,549 9/1936 Alden ..... 123/501
2,641,238 6/1953 Roosa ..... 123/506 X
4,050,432 9/1977 Davis et al. ..... 123/450 X
4,246,876 1/1981 Bouwkamp et al. ..... 123/467

*Primary Examiner*—Tony M. Argenbright
*Attorney, Agent, or Firm*—Prutzman, Kalb, Chilton & Alix

[57] ABSTRACT

A liquid fuel injection pump having a rotary distributor for unrestricted delivery of metered charges of fuel in succession to the fuel injection nozzles of an associated engine and having a snubber orifice with a snubber port provided either in the distributor stator for each distributor outlet port or in the rotor for the distributor delivery port for transmitting and damping a reverse pressure wave from each fuel injection nozzle back through the distributor.

7 Claims, 5 Drawing Figures

FUEL INJECTION PUMP SNUBBER

DESCRIPTION

1. Technical Field

The present invention relates to fuel injection pumps of the type having a distributor for delivering fuel under high pressure for sequential operation of the fuel injection nozzles of an internal combustion engine for injection of measured charges of fuel into the engine cylinders. More particularly, the present invention relates to a new and improved fuel injection pump snubber for preventing undesirable secondary nozzle operation and resulting secondary fuel injection immediately after primary fuel charge injection.

2. Background And Disclosure of Invention

In the operation of internal combustion engines where liquid fuel injection is employed, a metered charge of fuel is delivered under high pressure to each engine cylinder nozzle for injection of fuel into the cylinder in sychronism with the engine operating cycle. The nozzle is hydraulically operated by a high pressure pulse of fuel to inject a metered charge into the engine. When the pressure applied to the nozzle decreases, the nozzle closes and a reverse pressure wave or pulse is thereby generated. Under certain engine operating conditions, a reverse pressure wave or pulse of relatively high pressure can be generated which is reflected back downstream to the nozzle by an upstream fuel distributor or delivery valve to form a secondary nozzle operating pulse of sufficient magnitude to cause undesirable secondary fuel injection.

Accordingly, it is a primary object of the present invention to provide a new and improved fuel injection snubber for automatically damping reverse pressure waves from the fuel injection nozzle for preventing undesirable secondary fuel injection.

It is another object of the present invention to provide a new and improved fuel injection snubber for a fuel pump of the type having a rotary fuel distributor and a positive displacement delivery valve upstream of the distributor and wherein the snubber cooperates with the delivery valve to prevent undesirable secondary fuel injection.

It is a further object of the present invention to provide in a rotary distributor type fuel injection pump of conventional design a new and improved fuel snubber which enables the pump to deliver a measured fuel charge to each fuel injection nozzle of an associated engine without reflected pressure wave caused secondary fuel injection.

It is a further object of the present invention to provide a new and improved fuel injection pump snubber system having a single snubber for all of the fuel injection nozzles of an associated engine.

It is another object of the present invention to provide a new and improved fuel injection pump snubber of economical design having no moving parts and providing a long service free life.

It is another object of the present invention to provide a new and improved fuel injection snubber for a fuel pump having a rotary distributor and charge measure governing.

Other objects will be in part obvious and in part pointed out more in detail hereinafter.

A better understanding of the invention will be obtained from the following detailed description and the accompanying drawings of illustrative applications of the invention.

BEST MODES FOR CARRYING OUT THE INVENTION

Figure 1:
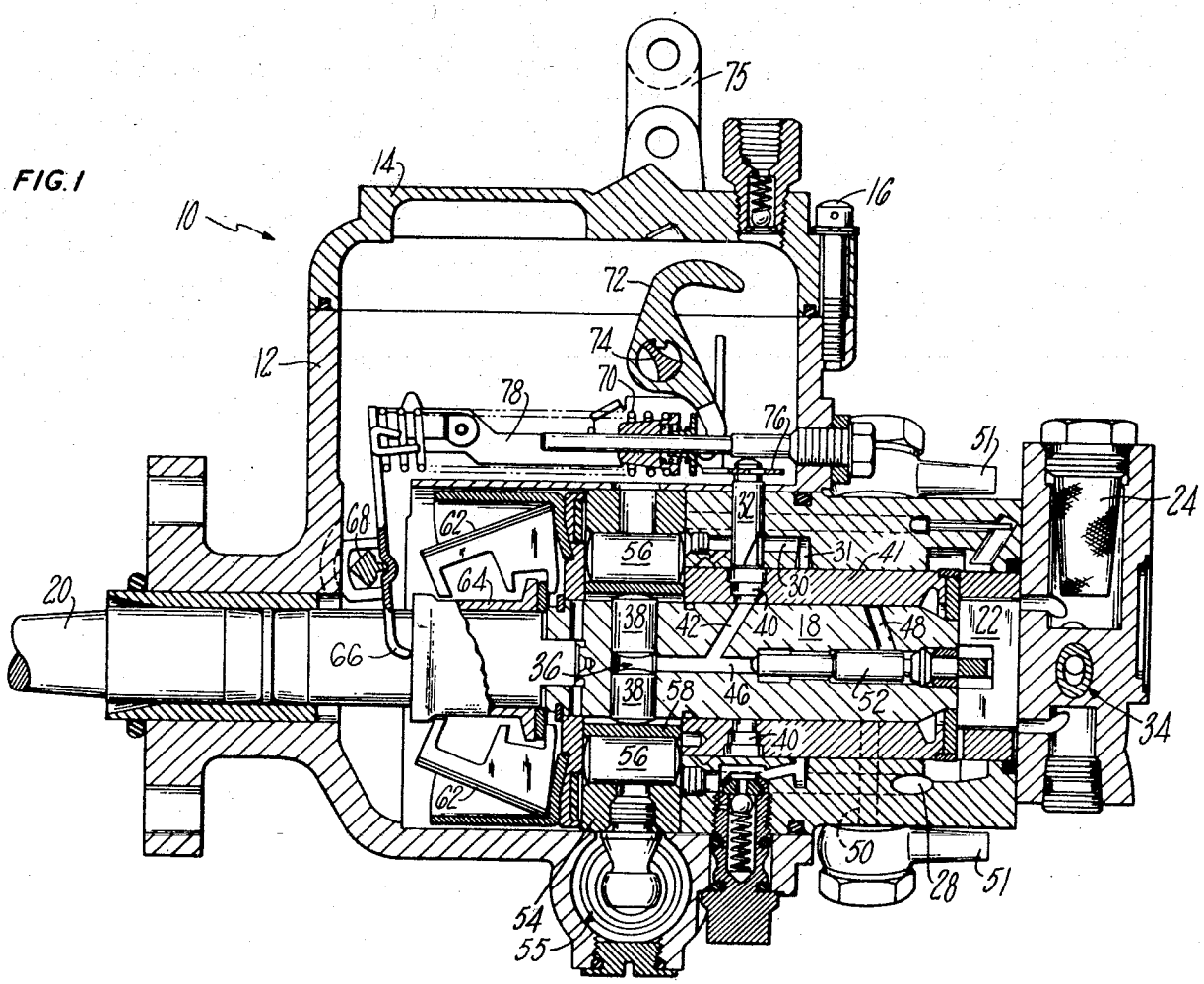
FIG. 1 is a side section view, partly broken away and partly in section, of a fuel injection pump incorporating a snubber of the present invention.

Referring now to the drawings in detail, wherein like numerals represent like parts, a fuel pump 10 is shown in FIG. 1 of the type shown and described in U.S. Pat. No. 3,704,963 of Leonard N. Baxter, dated Dec. 5, 1972, and entitled "Fuel Pump." Briefly, the fuel pump 10 is adapted to supply measured pulses or charges of fuel to the several fuel injection nozzles (not shown) of an internal combustion engine (not shown). A pump housing 12 having a cover 14 secured by fasteners 16 rotatably supports a pump rotor 18 having a drive shaft 20 with a tapered end for receiving a drive gear (not shown) for driving the pump in synchronism with the associated internal combustion engine (not shown).

A vane-type transfer or low pressure supply pump 22 driven by the rotor 18 receives fuel via a fuel inlet 24 from a suitable fuel reservoir (not shown) and delivers fuel under pressure via an axial bore 28, an annulus 31 and an axial bore 30 to a fuel inlet metering valve 32. A transfer pressure regulating valve 34 regulates the output pressure of the transfer pump 22 and returns excess fuel to the transfer pump inlet 24.

A high pressure charge pump 36 driven by the rotor 18 comprises a pair of opposed plungers 38 reciprocable in a diametral bore of the rotor. The charge pump 36 receives metered fuel from the metering valve 32 through an annular arrangement of a plurality of angularly spaced radial passages 40 in a fixes stator sleeve 41 which have sequential registration with a diagonal inlet passage 42 of the rotor 18 as it rotates. Fuel under high pressure is delivered by the charge pump 36 through an axial bore 46 in the rotor 18 to a rotary distributor having a radially extending but diagonal fuel delivery bore or passage 48. The unrestricted fuel delivery bore 48 is located for sequential registration with a plurality of angularly spaced distributor outlet passages or bores 50 in the stator sleeve 41 which communicate with respective individual fuel injection nozzles (not shown) via fuel line connectors 51 spaced around the periphery of the housing 12. A positive displacement fuel delivery valve piston 52 of a delivery valve (which for example may be of the type shown in U.S. Pat. No. 3,368,490 of M. A. Virello, dated Feb. 13, 1968 and entitled "Fuel Pump And Pressure Equalization Means Therefor") is reciprocably mounted in the axial bore 46 and is axially biased to an upstream closed position by a suitable return compression spring (not shown). The delivery valve operates in a conventional manner for achieving a sharp cutoff of fuel to the nozzles and thereby eliminates fuel dribble into the engine combustion chamber after fuel injection.

The angularly spaced radial inlet passages 40 to the charge pump 36 and the angularly spaced outlet passages 50 of the rotary distributor are located to provide registration respectively with the diagonal pump inlet passage 42 during the intake stroke of the plungers 38 and with the unrestricted fuel delivery passage 48 during the compression stroke of the plungers 38.

An annular cam 54 having a plurality of pairs of diametrically opposed camming lobes is provided for actuating the charge pump plungers 38 inwardly together for periodically delivering pulses of pressurized fuel to the engine fuel injection nozzles (not shown) for injection of fuel charges into the associated engine cylinders (not shown). A pair of rollers 56 and roller shoes 58 are mounted in radial alignment with the plungers 38 by a rotor driven carrier (not shown) for camming the plungers inwardly. For timing the distribution of the pressurized fuel to the fuel nozzles in proper synchronism with the engine operation, the annular cam 54 is adapted to be angularly adjusted by a suitable charge timing mechanism 55.

A plurality of governor weights 62, angularly spaced about the pump shaft 20, provide a variable governing bias on a sleeve 64 which engages a governor plate 66 to urge it clockwise as viewed in FIG. 1 about a support pivot 68. The governor plate 66 is urged in the opposite pivotal direction by a compression spring 70 having a bias which is adjustably by a lever 72 operated by a throttle shaft 74 connected to a throttle arm 75. The governor plate 66 is connected for controlling the angular position of the metering valve 32 by a control arm 76 on the metering valve and a link 78 pivotally connected to the control arm 76 and normally biased by a tension spring (not shown) into engagement with the governor plate 66.

As is well known, the quantity or measure of the charge of fuel delivered by the charge pump 36 is readily controlled by varying the inlet fuel restriction with the metering valve 32. The pump governor controls the angular position of the metering valve 32 to maintain the engine speed under varying engine load conditions at the speed established by the throttle shaft 74. Rotation of the metering valve 32 under the control of the pump governor varies the metering valve restriction between the passages 30 and 40 and thus varies the fuel delivered by the pump to maintain the associated engine at a speed determined by the setting of the governor.

In accordance with the present invention, a fuel pump snubber is provided by the distributor for automatically preventing undesirable secondary fuel injection by damping reverse pressure waves or pulses from each fuel nozzle (not shown) which occur as a result of a primary or normal fuel charge injection.

Figure 2:
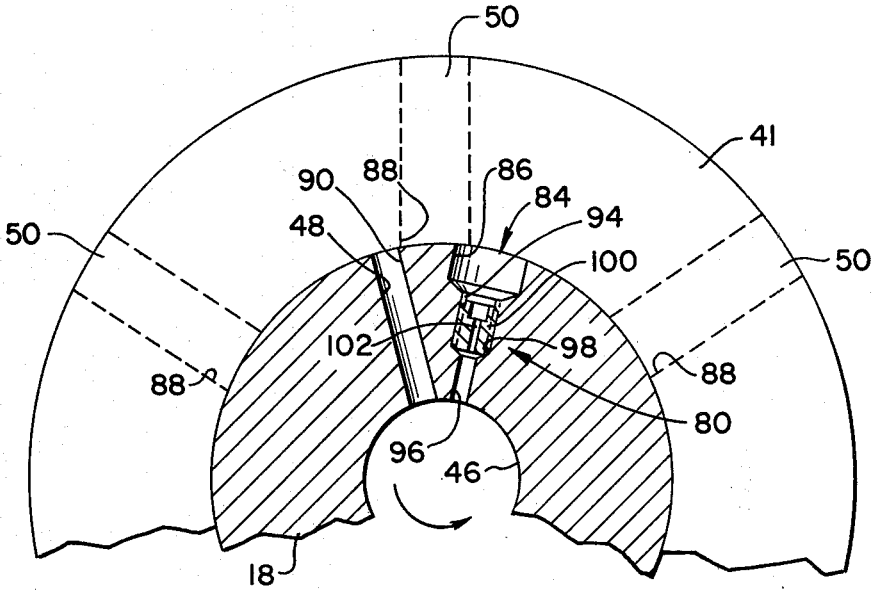
FIG. 2 is an enlarged partial transverse section view, partly broken away and partly in section, of the fuel injection pump showing a rotary distributor having a first embodiment of a snubber incorporating the present invention.

A first embodiment 80 of a snubber incorporating the present invention is shown in detail in FIG. 2. The snubber 80 comprises a stepped generally radially extending snubber bore 84 in the rotor 18 which is shown as being inclined to the axis of the rotor 18 like the diagonal fuel delivery bore 48. The radial snubber bore 84 trails the radial fuel delivery bore 48 of the rotary distributor and has an enlarged peripheral port 86 with trails the peripheral port 90 of the distributor delivery bore 48 into alignment with each distributor outlet port 88.

In a conventional manner, the size and angular location of the leading fuel delivery port 90 is established to rotate into registry with each outlet port 88 and to maintain an adequate interval of registry therewith to accommodate load and timing changes through the entire engine operating range. The trailing snubber port 86 is angularly located so that it rotates into registry with each distributor outlet port 88 later than the leading fuel delivery port 90, for example about 5° before the leading fuel delivery port 90 rotates completely out of registry with that outlet port 88. The trailing snubber port 86 is sized so that it remains in registry with the outlet port 88 for a substantial angular interval of rotation of the distributor for receiving the first and preferably also any succeeding reverse pressure waves or pulses from the respective fuel injection nozzle after fuel charge injection and the nozzle has closed. Also, the trailing snubber port 86 is angularly located and sized so that it has rotated out of registry with the outlet port 88 before the leading fuel delivery port 90 has rotated into registry with the next outlet port 88 and before the next fuel delivery pulse from the charge pump.

The time interval between the transmission of a fuel delivery pulse through the fuel distributor to a fuel injection nozzle and the return of a reverse pressure wave to the fuel distributor from the fuel injection nozzle is a function of injection pipe length, the velocity of sound in fuel and other factors that are characteristic of the specific injection system involved which are established experimentally. A determination of this time period permits the size and spacing of delivery port 90, outlet port 88 and snubber port 86 to be selected so as to provide substantially unrestricted passage of the fuel delivery pulse via ports 88 and 90 and to register the outlet port 88 with only the snubber port 86 at the time of arrival of the first reflected pressure wave such that communication between passages 50 and 46 is restricted such as by small passage 102.

The stepped radial snubber bore 84 has intermediate and inner bore sections 94,96 respectively of decreasing diameter. An annular radial shoulder 98 is formed between the intermediate and inner bore sections 94,96 and the intermediate bore section 94 is internally threaded for receiving an externally threaded snubber insert 100 having a restricted orifice 102 with a diameter of for example 0.020 inch to severely restrict the free flow of fuel therethrough. The snubber orifice 102 provides for damping the reverse pressure waves or pulses transmitted from the fuel injection nozzle. The snubber restricted orifice 102, in damping the reverse pressure waves provides for substantially reducing the intensity of any resultant reflected secondary pressure wave or pulse rebounding downstream to the fuel nozzle. The snubber restricted orifice 102 functions to split or diffuse the pressure wave energy by permitting part of the wave energy to continue upstream, thereby preventing secondary fuel nozzle injection by minimizing the intensity of any resultant reflected secondary pressure wave or pulse.

Also, the snubber restricted orifice 102 provides for returning fuel to the fuel delivery valve to eliminate or minimize any fuel vapor or fuel cavitation which might otherwise be present within the delivery valve chamber when the delivery valve closes. Thus, when the positive displacement fuel delivery valve piston 52 is returned to its upstream or closed position by its return spring at the end of each fuel charge pulse from the charge pump, the snubber provides for supplying fuel via the snubber restriction for reducing or preventing cavitation downstream of the delivery valve piston 52. The snubber and delivery valve thereby cooperate to provide a controlled removal of energy from each reverse pressure wave to reduce the possibility of secondary fuel injection.

Figure 3:
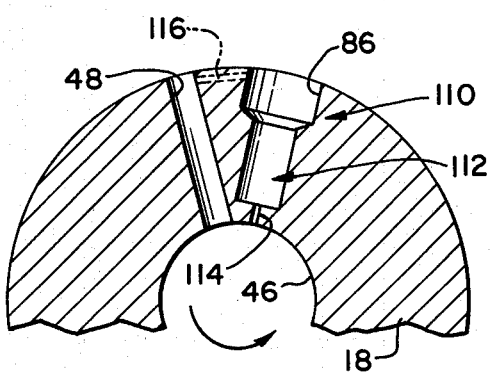
FIGS. 3, 4 and 5 are enlarged partial transverse section views, partly broken away and partly in section, showing a rotary distributor having second, third, fourth and fifth embodiments of a snubber incorporating the present invention.
Figure 4:
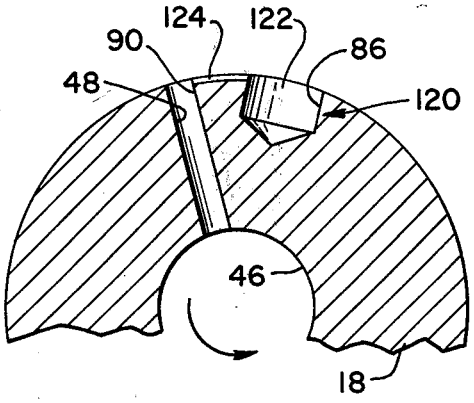
Figure 5:
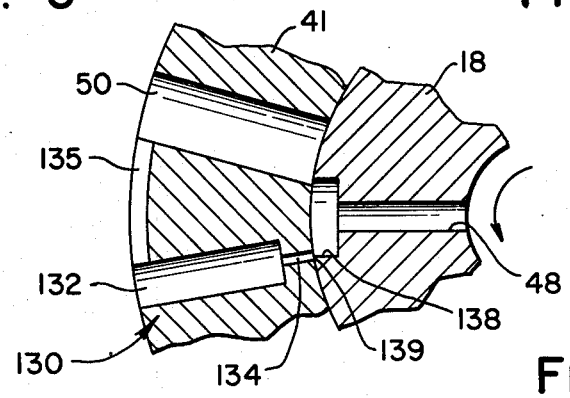

Alternative snubber embodiments 110,120 and 130 incorporating the present invention are shown in FIGS. 3, 4 and 5 respectively. In the two alternative embodiments shown in FIG. 3, a trailing generally radially extending snubber bore 112 has a small diameter orifice 114 at its inner radial end as shown in full lines in FIG. 3 or is formed as a blind hole (without the orifice 114) and a similar size orifice 116 (shown in broken lines in FIG. 3) is drilled between the blind bore and the distributor delivery bore 48. In the snubber embodiment 120 shown in FIG. 4, a blind snubber bore 122 is connected to the distributor delivery bore 48 by a small groove 124 having for example a V-shaped cross section and extending peripherally on the rotor 18 between the leading port 90 of the distributor delivery bore 48 and the trailing port 86 of the radial snubber bore 122.

In the snubber embodiment 130 shown in FIG. 5, a leading radially extending stepped snubber bore 132 having a small diameter snubber orifice 134 at its inner radial end is provided in the distributor stator sleeve 41 for each stator outlet bore 50. Each snubber bore 132 is connected to the respective trailing stator outlet bore 50 by a short peripheral groove 135 in the stator sleeve 41. Also, the radial fuel delivery bore 48 in the rotor 18 is provided with an enlarged peripheral port 138 to maintain an adequate interval of registry with each snubber orifice port 139 in the stator for receiving the first and preferably also any succeeding reverse pressure waves or pulses from the respective nozzle as described with reference to the embodiment of FIG. 2.

In all five embodiments described, the snubber port 86 or 139 is angularly located as previously described to transmit a reverse pressure wave from the corresponding fuel injection nozzle through the distributor to the delivery valve, preferably through the entire speed and load range of the associated engine, but in any case during high speed and high load engine operation when relatively high energy reverse pressure waves and resultant secondary fuel injection are most likely to occur. Accordingly, in each of the five embodiments described, the snubber provides for effectively damping the reverse pressure waves to reduce the possibility of secondary fuel injection.

As will be apparent to persons skilled in the art, various modifications, adaptations and variations of the foregoing specific disclosure can be made without departing from the teachings of the present invention.

I claim:

1. In a liquid fuel injection system for a multiple cylinder internal combustion engine having a fuel injection nozzle for each cylinder adapted to be momentarily opened by a pulse of pressurized fuel for injecting a fuel charge into the cylinder, a positive displacement charge pump for periodically developing pulses of pressurized fuel for injection of fuel charges into the engine cylinders in synchronism therewith, a rotary fuel distributor providing a plurality of fuel outlet ports respectively connected to the nozzles, a distributor rotor member rotatable in synchronism with an associated internal combustion engine and having a fuel delivery passageway with a fuel delivery port sequentially registerable with the fuel outlet ports for conducting the fuel pulses from the charge pump to the fuel injection nozzles, a fuel delivery valve in the said fuel delivery passageway intermediate the charge pump and fuel delivery port for maintaining a positive residual fuel pressure at each nozzle after injection of fuel thereby, and fuel snubber means for damping a reverse pressure pulse from each nozzle when the nozzle closes at the completion of fuel injection thereby; the improvement wherein the snubber means comprises a snubber passageway in the rotor connected to the said fuel delivery passageway downstream of the fuel delivery valve and having a snubber port trailing the fuel delivery port for sequential registry with the fuel outlet ports for receiving a reverse pressure pulse from each nozzle after the fuel delivery port has rotated past the respective outlet port and a snubber passageway flow restrictor between the snubber port and said fuel delivery passageway for damping, downstream of the fuel delivery valve, the reverse pressure pulse conducted from each nozzle toward the fuel delivery valve and downstream of the fuel delivery valve and thereby permit the fuel delivery valve to maintain a positive residual fuel pressure at each nozzle after injection of fuel thereby.

2. The device of claim 1 wherein the snubber passageway restrictor is provided by an orifice insert in the snubber passageway.

3. The device of claim 1 wherein the fuel delivery passageway comprises a radially extending fuel delivery bore and wherein the snubber passageway restrictor extends between the snubber port and fuel delivery bore.

4. The device of claim 1 wherein the snubber passageway restrictor is formed by a peripheral groove on the distributor member interconnecting the snubber and fuel delivery ports.

5. In a liquid fuel injection pump for a multiple cylinder internal combustion engine for fuel injection nozzles for injecting fuel charges into the engine cylinders, the fuel injection pump having a charge pump for delivering periodic short pulses of pressurized fuel to the fuel injection nozzles for injection of fuel charges into the engine cylinders, a fuel distributor with a stator with a plurality of unrestricted fuel passageways for the fuel injection nozzles respectively and a distributor member, adapted to be driven in synchronism with an associated internal combustion engine, having an unrestricted fuel delivery passageway sequentially registerable with the plurality of stator passageways respectively for conducting the fuel pulses from the charge pump to the fuel injection nozzles, and a fuel delivery valve in the said unrestricted fuel delivery passageway intermediate the charge pump and fuel delivery port for maintaining a positive residual fuel pressure at each nozzle after injection of fuel thereby, the improvement wherein the fuel distributor comprises snubber fuel passageway means with orifice means providing restricted communication, downstream of the fuel delivery valve, between each unrestricted stator passageway and the unrestricted fuel delivery passageway after the delivery of a fuel pulse to the corresponding fuel injection nozzle for receiving reverse pressure pulses from the nozzle for damping a reverse fuel pressure pulse from the fuel injection nozzle to prevent secondary fuel injection caused by a reflected pressure pulse and yet permit the fuel delivery valve to maintain a positive residual fuel pressure at each nozzle after injection of fuel thereby.

6. In a liquid fuel injection pump for a multiple cylinder internal combustion engine with fuel injection nozzles for injecting fuel charges into the engine cylinders, the fuel injection pump having a charge pump for delivering periodic short pulses of pressurized fuel to the fuel injection nozzles for injection of fuel charges into the engine cylinder, a fuel distributor with a stator member with a plurality of unrestricted fuel passageways for the fuel injection nozzles respectively and a rotary distributor member, adapted to be rotated in synchronism with an associated internal combustion engine, having an unrestricted fuel delivery passageway sequentially registerable with the plurality of unrestricted stator passageways respectively for conducting the fuel pulses from the charge pump to the fuel injection nozzles, and a fuel delivery valve in the said unrestricted fuel delivery passageway intermediate the charge pump and fuel delivery port for maintaining a positive residual fuel pressure at each nozzle after injection of fuel thereby, the improvement wherein the distributor comprises snubber fuel passageway means with a snubber passageway in one of said distributor members for each said unrestricted passageway therein, each said snubber passageway having an orifice communicating with a said unrestricted fuel passageway of the other distributor member downstream of the fuel delivery valve for receiving a reverse fuel pressure pulse from the fuel injection nozzle after the delivery of a fuel pulse to said fuel injection nozzle and after unrestricted communication between said unrestricted passageway has ceased, thereby to dampen the reverse fuel pressure pulse downstream of the fuel delivery valve to prevent secondary fuel injection caused by a reflected pressure pulse and yet permit the fuel delivery valve to maintain a positive residual fuel pressure at each nozzle after injection of fuel thereby.

7. A fuel injection pump according to claim 5 or 6 wherein the snubber fuel passageway means comprises a snubber passageway in the stator for each of its said plurality of unrestricted fuel passageways, each snubber passageway having a fixed orifice and providing communication between the respective unrestricted stator passageway and the unrestricted fuel delivery passageway after the delivery of a fuel pulse to the corresponding fuel injection nozzle for transmitting and damping a fuel pressure pulse in the reverse direction from the fuel injection nozzle and through the distributor to prevent secondary fuel injection caused by a reflected pressure pulse.

* * * * *